US007722165B2

(12) United States Patent
Iriguchi

(10) Patent No.: US 7,722,165 B2
(45) Date of Patent: May 25, 2010

(54) LIQUID-DROPLET JETTING APPARATUS

(75) Inventor: Akira Iriguchi, Ichinomiya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 838 days.

(21) Appl. No.: 11/635,473

(22) Filed: Dec. 7, 2006

(65) Prior Publication Data

US 2007/0126803 A1 Jun. 7, 2007

(30) Foreign Application Priority Data

Dec. 7, 2005 (JP) ..... 2005-353123

(51) Int. Cl.
*B41J 2/045* (2006.01)

(52) U.S. Cl. ..... 347/71; 347/68

(58) Field of Classification Search ..... 347/68–72
See application file for complete search history.

(56) References Cited

U.S. PATENT DOCUMENTS 6,595,628 B2 7/2003 Takagi et al.
2005/0205687 A1* 9/2005 Chang ..... 239/102.2

FOREIGN PATENT DOCUMENTS

JP 2002-254634 9/2002
JP 2004291543 10/2004

* cited by examiner

*Primary Examiner*—Stephen Meier
*Assistant Examiner*—Geoffrey Mruk
(74) *Attorney, Agent, or Firm*—Eugene LeDonne; Joseph W. Treloar; Frommer Lawrence & Haug LLP

(57) ABSTRACT

In a liquid-droplet jetting apparatus constructed to change volume of pressure chambers in a cavity unit by displacement of active portions in a piezoelectric actuator so as to jet liquid in the pressure chambers from nozzles, respectively, the pressure chambers and the active portions extend on a predetermined plane; a length in a longitudinal direction of each of the active portions is not more than 1.5 mm, a height of each of the pressure chambers is 40 μm to 60 μm, and a thickness of a member which defines surfaces, of the pressure chambers, on a side opposing the piezoelectric actuator is 100 μm to 150 μm. The liquid-droplet jetting apparatus can stably jet a liquid-droplet having a minute volume at a predetermined speed without increasing a drive voltage applied to the active portions.

10 Claims, 8 Drawing Sheets

| NOZZLE ROW NUMBER | A ROW | B ROW | C ROW | D ROW | E ROW |
|---|---|---|---|---|---|
| PZT ACTIVE-PORTION LENGTH(mm) | 0.9 | 0.8 | 1.7 | 1.2 | 1.3 |
| LENGTH OF PRESSURE CHAMBER (mm) | 1.2 | 1.1 | 1.8 | 1.5 | 1.6 |
| NOZZLE DIAMETER(μm) | 18.0 | 18.0 | 20.5 | 20.5 | 20.5 |

| CAVITY THICKNESS T1 (μm) | JETTING SPEED(m/s) | |
|---|---|---|
| | BK | CL |
| 30 | 13.4 | 12.4 |
| 40 | 13.8 | 14.0 |
| 50 | 15.3 | 15.3 |
| 60 | 16.2 | 13.6 |
| 80 | 13.4 | 11.2 |
| 100 | 11.5 | 8.9 |

LIQUID-DROPLET JETTING APPARATUS

CROSS REFERENCE TO RELATED APPLICATION

The resent application claims priority from Japanese Patent Application No. 2005-353123, filed on Dec. 7, 2005, the disclosure of which is incorporated herein by reference in its entirety.

BACKGROUND OF THE INVENTION

1. Field of the Invention

The present invention relates to a liquid-droplet jetting apparatus constructed to jet (discharge) liquid-droplets of a liquid from a cavity unit by displacement of an active portion in a piezoelectric actuator.

2. Description of the Related Art

As a liquid-droplet jetting apparatus, there is an ink-jet head and the like. In Japanese Patent Application Laid-open No. 2004-291543 or the like, an embodiment of the ink-jet head is described which is constructed such that a jetting pressure is applied from a piezoelectric actuator to a cavity unit having nozzles so as to jet droplets of an ink (ink-droplets) from the nozzles. For example, in an embodiment disclosed in the Japanese Patent Application Laid-open No. 2004-291543, the cavity unit is formed in a substantially flat shape, and inside the cavity unit, ink supply channels, each of which is formed to range from one of pressure chambers, formed to open on one wide surface of the cavity unit, to reach one of nozzles formed to open on the other wide surface thereof, are provided for the nozzles respectively.

On the other hand, the piezoelectric actuator has a plurality of piezoelectric layers, individual electrodes provided for the pressure chambers respectively, and common electrodes each of which is arranged to cover the plurality of pressure chambers. In this piezoelectric actuator, areas of the piezoelectric layers, sandwiched between the individual electrodes and the common electrodes from thereabove and thereunder, are active portions which displace or deforms by a drive voltage applied between the individual electrodes and the common electrodes. Then, the piezoelectric actuator is stacked and fixed on the one wide surface of the cavity unit so that the active portions correspond to the pressure chambers respectively.

In the ink-jet head constructed in such a manner, displacement of an active portion changes the volume of a pressure chamber to thereby jet an ink filled in the pressure chamber from a nozzle. Therefore, to jet ink-droplets in a predetermined amount and at a predetermined speed, it is necessary to generate a predetermined amount of volumetric change in the pressure chamber.

With respect to the ink-jet head as an liquid-droplet jetting apparatus, there are tendencies to increase the degree of integration (densification) in a plane arrangement of nozzles and to decrease the plane area dimension of pressure chambers, so as to correspond to the miniaturization of the ink-jet head, the highly densified recording, and to the micronization of liquid-droplet in recent years. Accordingly, the reduction of the length of a channel (including a pressure chamber) needed for one nozzle not only makes it possible to realize the adaptation to the miniaturization of the ink-jet head and to the micronization of liquid-droplets, but also shortens an inherent cycle of a pressure fluctuation generated in the ink, thereby increasing a driving frequency of the jetting, which in turn is effective to realize the high-speed recording. However, this inevitably leads to the reduction in the plane area dimension of the active portions provided for the pressure chambers respectively, and thus it is necessary to increase the displacement amount of the active portions so that the volumetric change is applied, to the pressure chambers, in a predetermined amount by the active portions as a whole. Consequently, the drive voltage required for driving the active portions is needed to be set high. Further, the cavity unit is not a perfectly rigid body. Therefore, the displacement of active portion or portions is absorbed by the displacement of the cavity unit, causing a problem such that a predetermined jetting speed cannot be obtained without further setting the drive voltage higher.

SUMMARY OF THE INVENTION

The present invention is made to solve the above-described problems, and an object thereof is to realize a liquid-droplet jetting apparatus capable of applying a volumetric change sufficient for the jetting to a pressure chamber so as to obtain a predetermined jetting speed, without increasing a drive voltage for a piezoelectric actuator even when the length of a pressure chamber is reduced accompanying with the highly densified or integrated arrangement of the nozzles. In the following description, reference numerals in parentheses added to respective elements or components are just for illustrating these elements or components merely as examples, and are not intended to limit these elements or components.

According to a first aspect of the present invention, there is provided a liquid-droplet jetting apparatus (100) which jets liquid-droplets of a liquid from a plurality of nozzles (4), the apparatus including: a cavity unit (1) which has the nozzles (4) and a plurality of pressure chambers (36) corresponding to the nozzles (4) respectively and extending on a predetermined plane (17); and a piezoelectric actuator (2) which has a plurality of active portions (54) extending corresponding to the pressure chambers (36) respectively, and which is formed on the cavity unit (1) so as to cover the plane (17); wherein a length (L1) in a longitudinal direction of each of the active portions (54) is not more than 1.5 mm; a height (T1) of each of the pressure chambers (36) is 40 μm to 60 μm; a thickness (T2) of a member (16) which defines surfaces, of the pressure chambers (36), on a side facing the piezoelectric actuator (2) is 100 μm to 150 μm; and volume of the pressure chambers (36) in which liquid is filled is changed by displacement of the active portions (54) so as to jet the liquid-droplets from the nozzles (4).

In the liquid-droplet jetting apparatus (100) of the present invention, the following fact was confirmed by an experiment. Namely, even when the length (L1) of each of the active portions (54) is reduced to be not more than 1.5 mm, it is possible to stably jet liquid-droplets having a minute volume at a predetermined speed without increasing a drive voltage applied to the active portions (54), by setting the height (T1) of each of the pressure chambers (36) to be 40 μm to 60 μm, and the thickness (T2) of the member (16) which defines the surfaces, of the pressure chambers (36), on a side facing the piezoelectric actuator (2) to be 100 μm to 150 μm.

In the liquid-droplet jetting apparatus (100) of the present invention, a length (width) (W1) in a short direction of each of the pressure chambers (36) may be 240 μm to 280 μm; the piezoelectric actuator (2) may have a plurality of base piezoelectric layers (51) which are stacked and a plurality of electrode layers (49) which sandwich the base piezoelectric layers (51) respectively therebetween; the electrode layers (49) may include a plurality of individual electrode layers in each of which a plurality of individual electrodes (46) extending corresponding to the pressure chambers (36) respectively are formed, and a plurality of common electrode layers in each of which a common electrode (47) is formed to cover the pressure chambers (36); areas, of each of the base piezoelectric layers (51), between the individual electrodes (46) and the common electrode (47) respectively may be formed as the active portions (54); a thickness (T51) of each of the base piezoelectric layers (51) may be 15 μm to 40 μm; and a length (width) (W3) in a short direction of each of the individual electrodes (46) may be 140 μm to 160 μm. When the thicknesses (T51, T52, T53) of the piezoelectric layers and the width (W3) of each of the individual electrodes (46) are changed, a displacement amount and an electrostatic capacitance of the active portions (54) are changed. In this case, by setting the thickness (T51, T52, T53) of each of the piezoelectric layers (51, 52, 53) to 15 μm to 40 μm, and setting the width (W3) of each of the individual electrodes (46) to 140 μm to 180 μm with respect to the width (W1) that is 240 μm to 280 μm in a direction orthogonal to the longitudinal direction of each of the pressure chambers (36), then the displacement amount and the electrostatic capacitance of the active portions (54) can be optimized further provided that the above-described conditions are satisfied regarding the length (L1) in the longitudinal direction of the active portions (54), the height (T1) of the pressure chambers (36), and the thickness (T2) of the member (16) which defines the surfaces, of the pressure chambers (36), on the side facing the piezoelectric actuator (2).

In the liquid-droplet jetting apparatus (100) of the present invention, the piezoelectric actuator (2) may further include: a top layer (53) arranged on a side opposite to the cavity unit (1) with respect to the base piezoelectric layers (51); and a bottom layer (52) arranged on a side opposite to the top layer (53) with respect to the base piezoelectric layers (51); the active portions (54) may be included only in each of the base piezoelectric layers (51); and a thickness (T52) of the bottom layer (52) and a thickness (T53) of the top layer (53) may be greater than the thickness (T51) of each of the base piezoelectric layers (51). Specifically, the thickness (T53) of the top layer (53) and the thickness (T52) of the bottom layer (52) may be 25 μm to 40 μm; and the thickness (T51) of each of the base piezoelectric layers (51) may be 15 μm to 30 μm. In this case, by making the thickness (T53) of the top layer (53) greater than the thickness (T51) of each of the base piezoelectric layers (51), displacement of the active portions (54) can be transmitted efficiently to the side of the pressure chambers (36) without allowing the displacement to escape to side of the top layer (53). Further, by making the thickness (T52) of the bottom layer (52) greater than the thickness (T51) of each of the base piezoelectric layers (51), it is possible to enhance an effect of preventing the ink filled in the pressure chambers (36) from permeating or infiltrating to the side of the piezoelectric actuator (2). Further, by making the thickness (T53) of the top layer (53) and the thickness (T52) of the bottom layer (52) to be great, it is possible to prevent a warpage which would be otherwise caused due to the unbalance or difference in thickness between the layers near to the top and bottom, respectively, of the piezoelectric actuator (2) when the piezoelectric actuator (2) is sintered during the production process thereof. Therefore, it is possible to make the active portions (54) in the piezoelectric actuator (2) act on the pressure chambers (36) respectively, in a substantially uniform manner. Further, by setting the thickness (T53) of the top layer (53) to be 25 μm to 40 μm and setting the thickness (T52) of the bottom layer (52) to be 25 μm to 40 μm, and by setting the thickness (T51) of each of the base piezoelectric layers (51) to be 15 μm to 30 μm, these layers can be formed stably during the production of the piezoelectric actuator (2).

In the liquid-droplet jetting apparatus (100) of the present invention, the piezoelectric actuator (2) may further include a top layer (53) arranged on a side opposite to the cavity unit (1) with respect to the base piezoelectric layers (51), and a bottom layer (52) arranged on a side opposite to the top layer (53) with respect to the base piezoelectric layers (51); the active portions (54) may be included only in the base piezoelectric layers (51); and a thicknesses (T51) of a base piezoelectric layer (51), among the plurality of base piezoelectric layers (51), which is closest to the top layer (53) and a thickness (T52) of the bottom layer (52) may be greater than thicknesses (T51) of base piezoelectric layers (51), among the plurality of base piezoelectric layers, which are different from the piezoelectric layer (51) closest to the top layer (53). Specifically, the thickness (T51) of the base piezoelectric layer (51) closest to the top layer (53) and the thickness (T52) of the bottom layer (52) may be 25 μm to 40 μm; and the thicknesses (T51) of the base piezoelectric layers (51), which are different from the base piezoelectric layer (51) closest to the top layer (53), may be 15 μm to 30 μm. In this case, by making the thickness (T51) of the base piezoelectric layer (51) which is closest to the top layer (53) and the thickness (T52) of the bottom layer (52) to be great, it is possible to prevent the warpage which would be otherwise cause due to the difference in thickness between the layers nearer to the top and bottom portion of the piezoelectric actuator (2) when the piezoelectric actuator (2) is sintered during the production of the piezoelectric actuator (2). Accordingly, it is possible to make the active portions (54) in the piezoelectric actuator (2) act on the pressure chambers (36) in a substantially uniform manner. Further, by making the thickness (T52) of the bottom layer (52) greater than the thickness (T51) of each of the base piezoelectric layers (51), it is possible to enhance the effect of preventing the ink filled in the pressure chambers (36) from permeating to the side of the piezoelectric actuator (2). Further, by setting the thickness (T51) of the base piezoelectric layer (51) which is closest to the top layer (53) and the thickness (T52) of the bottom layer (52) to be 25 μm to 40 μm; and by setting the thickness (T51) of each of the base piezoelectric layers (51), among the plurality of base piezoelectric layers (51), which are different from the base piezoelectric layer (51) closest to the top layer (53), to be 15 μm to 30 μm, these layers can be formed stably during the production of the piezoelectric actuator (2).

In the liquid-droplet jetting apparatus (100) of the present invention, in the cavity unit (1), a member (17) in which the plurality of pressure chambers (36) is formed and the member (16) which defines the surfaces, of the pressure chambers (36), on the side facing the piezoelectric actuator (2) may be made of a nickel alloy steel plate.

In the liquid-droplet jetting apparatus (100) of the present invention, the length (L1) in the longitudinal direction of each of the active portions (54) may be not more than 1.2 mm. The inventor confirmed the following fact by the experiment that, even when the length (L1) in the longitudinal direction of each of the active portions (54) is reduced to be not more than 1.2 mm, it is possible to stably jet a liquid-droplet having a minute volume at a predetermined speed without increasing the drive voltage applied to the active portions (54), by setting the height (T1) of each of the pressure chambers (36) to be 40 μm to 60 μm and by setting the thickness (T2) of the member (16) which defines the surfaces, of the pressure chambers (36), on the side facing the piezoelectric actuator (2) to be 100 μm to 150 μm.

In the liquid-droplet jetting apparatus (100) of the present invention, when the length (L1) in the longitudinal direction of each of the active portions is 0.9 mm to 1.3 mm, a drive voltage for jetting the liquid-droplets at a jetting speed of 9 m/s may be 23.5 volts to 27 volts.

The liquid-droplet jetting apparatus (100) of the present invention may be an ink-jet head.

DETAILED DESCRIPTION OF THE PREFERRED EMBODIMENTS

In the following, a basic embodiment of the present invention will be explained using FIGS. 1 to 7.

Figure 1:
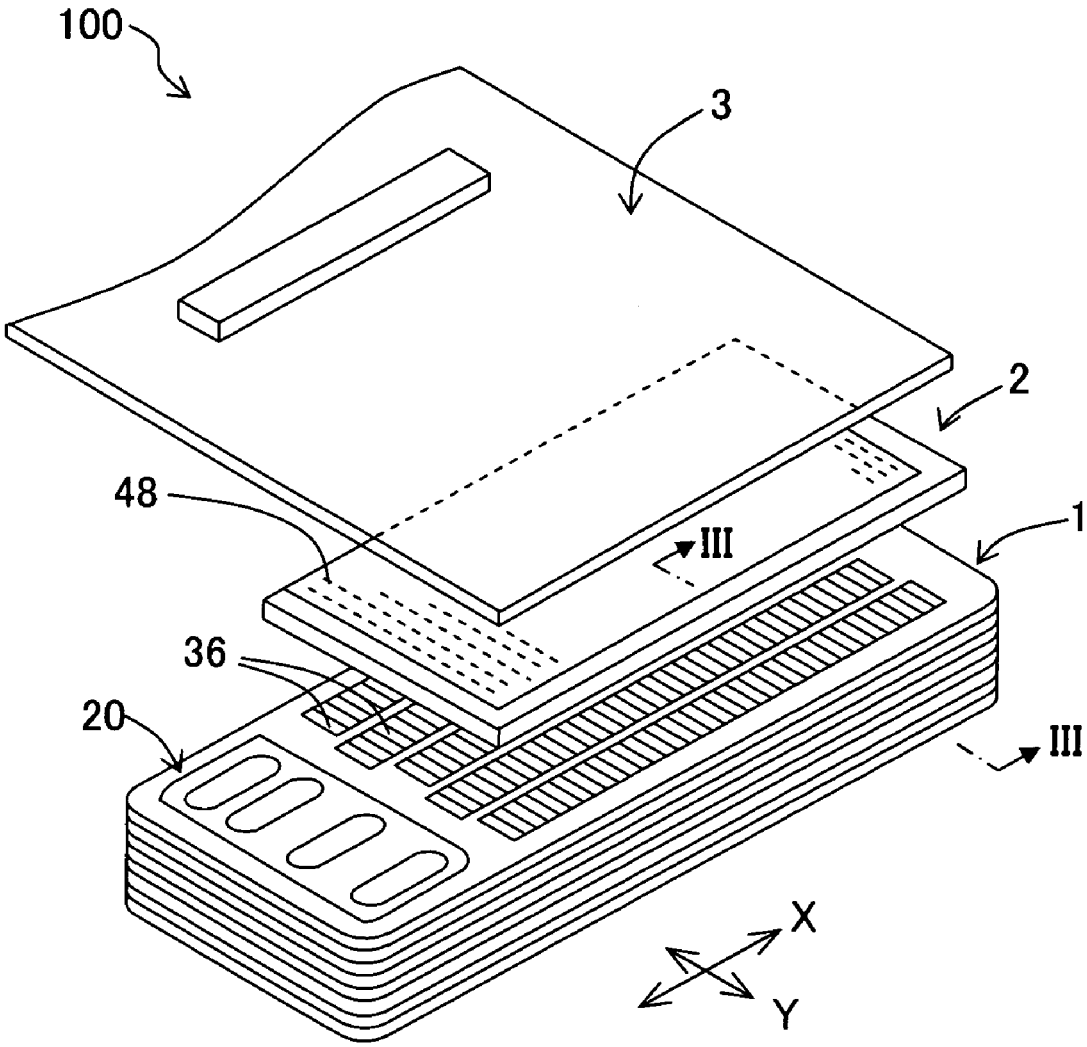
FIG. 1 is an exploded perspective view of an ink-jet head as a liquid-droplet jetting apparatus.

FIG. 1 is an exploded perspective view of an ink-jet head 100 as an embodiment of a liquid-droplet jetting apparatus. The ink-jet head 100 is constructed such that a plate-shaped piezoelectric actuator 2 is joined to a cavity unit 1 provided with a plurality of plates. A flexible flat cable 3 for connection to an external apparatus is stacked on and joined to the upper surface of this plate-shaped piezoelectric actuator 2. An ink is jetted downward from nozzles 4 (see FIG. 3) which are open on the side of the lower surface of the cavity unit 1.

Figure 2:
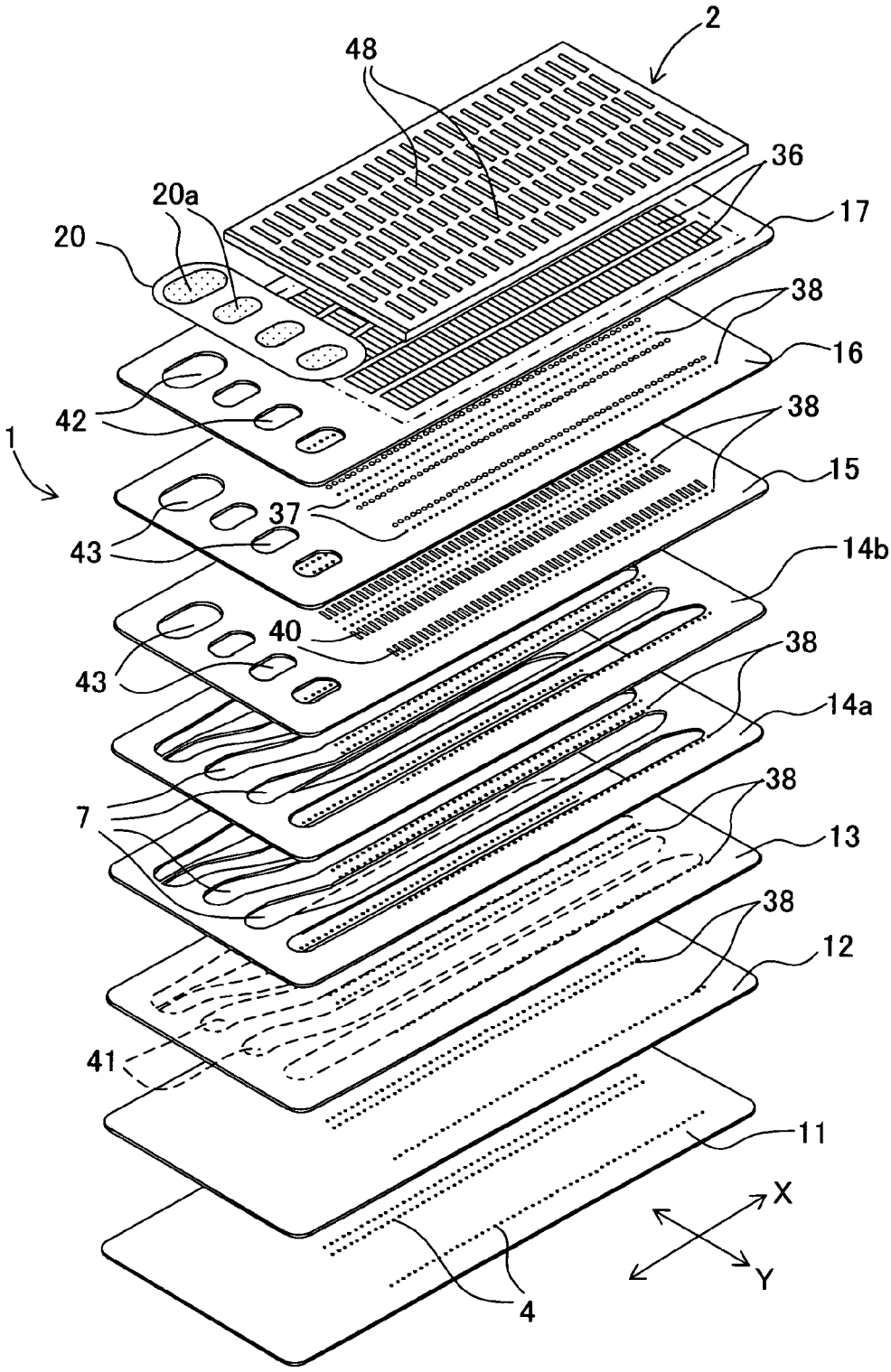
FIG. 2 is an exploded perspective view of a cavity unit.

As shown in FIG. 2, the cavity unit 1 is constructed such that eight thin flat plates in total, namely a nozzle plate 11, a spacer plate 12, a damper plate 13, two manifold plates 14*a* and 14*b*, a supply plate 15, a base plate 16, and a cavity plate 17 are stacked and joined together in a laminated form with an adhesive so that the respective flat plate mutually face at surfaces thereof. In this description, a direction in which these flat plates are stacked is referred to as "stacking direction" as appropriate.

In the embodiment, each of the plates 11 to 17 has a thickness of approximately 40 μm to 150 μm, and the nozzle plate 11 is made of synthetic resin such as polyimide, and the plates 12 to 17, other than plates 11, are made of a 42% nickel alloy steel (steel to which nickel is added) plate. In the nozzle plate 11, a large number of nozzles 4 each having a minute diameter (approximately 20 μm) are bored at minute spacing distances. These nozzles 4 are arranged in five rows along a longitudinal direction (X direction) of the nozzle plate 11. Although a nozzle pitch between adjacent nozzles in a row is set to 75 dpi (dot per inch), the nozzles may be highly integrated by a pitch of not less than 75 dpi.

Figure 3:
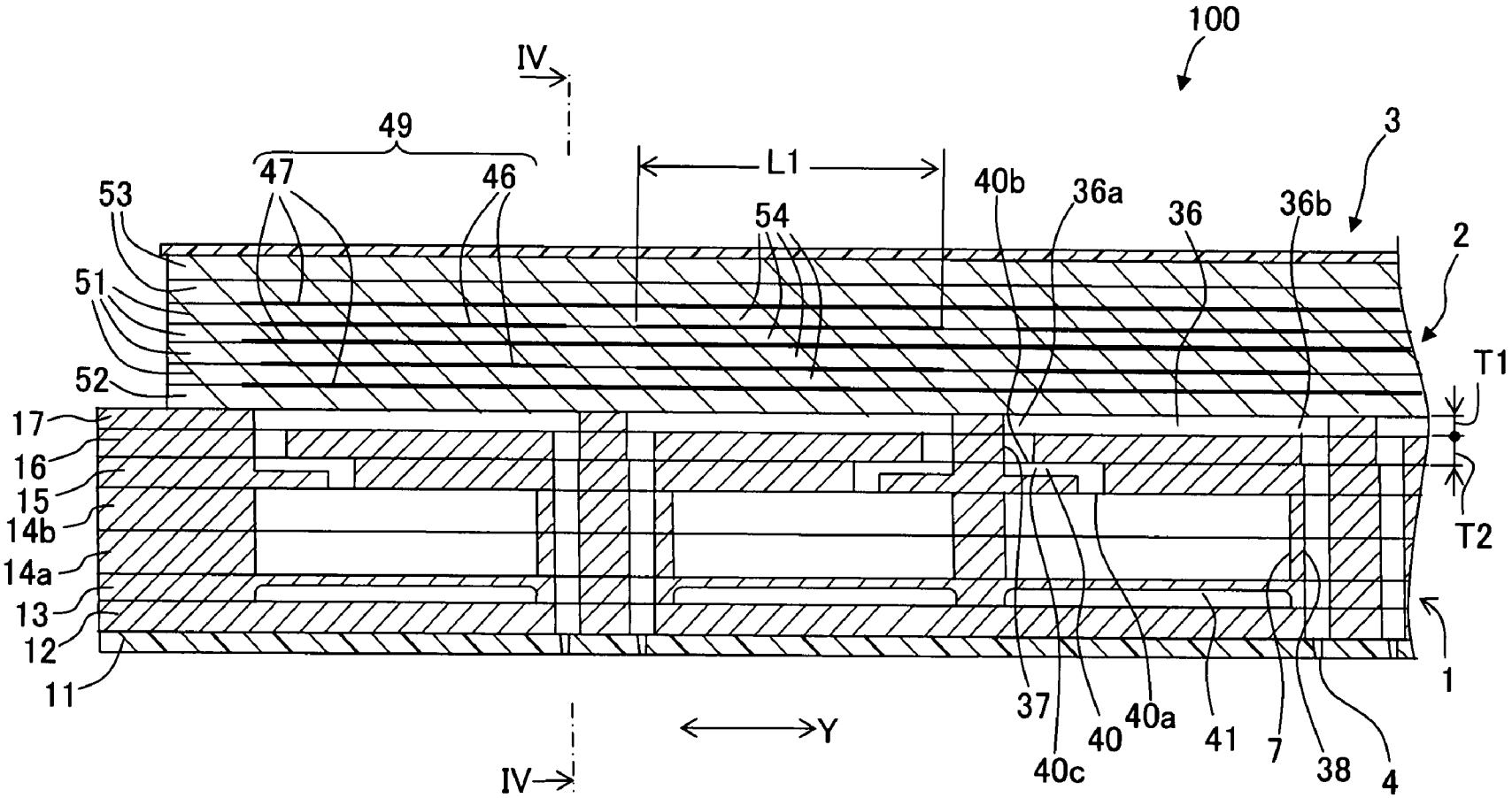
FIG. 3 is a cross-sectional view taken along a line indicated by arrows III-III in FIG. 1.

As shown in FIG. 3, the nozzles 4 are connected to pressure chambers 36, of the cavity plate 17, respectively, via through passages 38 which are bored through the spacer plate 12, the damper plate 13, the two manifold plates 14*a*, 14*b*, the supply plate 15, and the base plate 16. As shown in FIG. 2, in the cavity plate 17, a plurality of pressure chambers 36 are arranged in five rows (pressure-chamber rows) in parallel to a long side (X direction) of the cavity plate 17. Each of the pressure chambers 36 has a slender (elongated) shape in plan view and is bored penetrating the plate thickness of the cavity plate 17 so that a longitudinal direction of each of the pressure chambers 36 is in parallel to a short direction (Y direction) of the cavity plate 17. As shown in FIG. 3, each of the pressure chambers 36 communicates with a common ink chamber 7, at one end 36*a* thereof in the longitudinal direction, via a communication hole 37 and a connection channel 40, as will be described later; and each of the through passages 38 is connected to one of the pressure chambers 36 at the other end 36*b* thereof in the longitudinal direction. Each of the pressure chambers 36 is formed in a shape which is long along a direction in which the ink flows (ink-flow direction).

Figure 4:
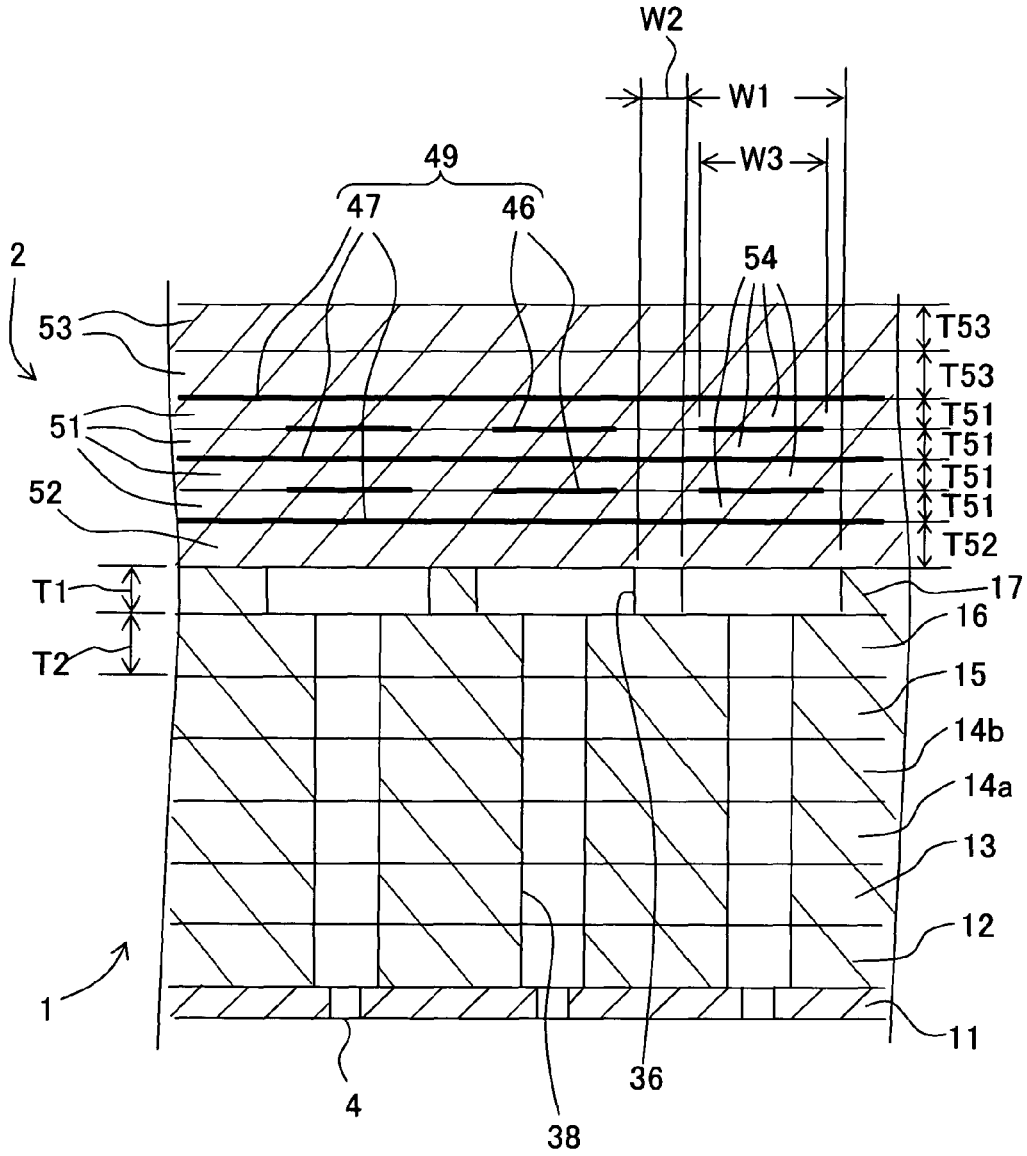
FIG. 4 is a cross-sectional view taken along a line indicated by arrows IV-IV in FIG. 3.
Figure 5:
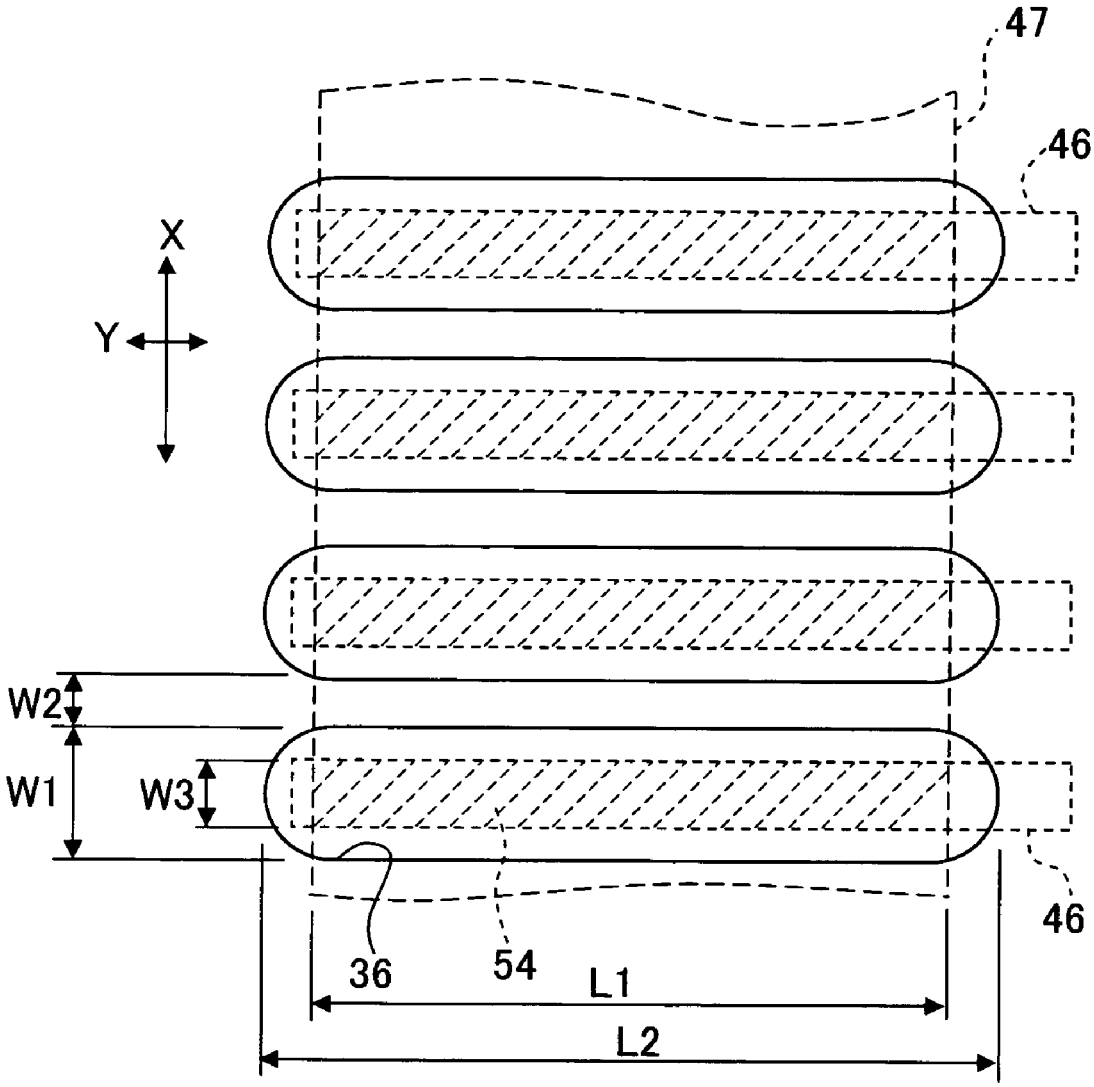
FIG. 5 is an explanatory view showing a positional relationship between pressure chambers and active portions.

The pressure chambers 36 are bored in (formed to penetrate through) the cavity plate 17 by a pitch corresponding to the aforementioned nozzle pitch of 75 dpi for the nozzles 4. Accordingly, for assuring the stability or the like in the production of the pressure chambers 36 in the cavity plate 17, it is desirable that a width W1 (as shown in FIGS. 4 and 5), of each of the pressure chambers 36 in a direction orthogonal to the ink flow, is 240 μm to 280 μm. In this case, a spacing distance W2 between adjacent pressure chambers 36 in a row is about 80 μm. Further, it is desirable that a height T1 of each of the pressure chambers 36 is 40 μm to 60 μm. Note that the term "height" of each of the pressure chambers 36 means a length, in the stacking direction, of the pressure chambers 36, in other words, a thickness T1 (see FIGS. 3 and 4) of the cavity plate 17. The results of an experiment conducted with respect to the height T1 of each of the pressure chambers 36 will be described later. Note that the length L2 in the ink-flow direction (length in the longitudinal direction) of each of the pressure chambers 36 is set to be greater, than the length of an active portion 54 (to be described later), approximately by 0.1 mm to 0.3 mm, and there are prepared two types of the pressure chambers having two L2, respectively, one being 1.4±0.1 mm to 1.5±0.1 mm (hereinafter referred to as "1.4 mm"), and the other being 1.1±0.1 mm to 1.2±0.1 mm (hereinafter referred to as "1.1 mm"). Note that the above-mentioned width and height are common for these two types. These two types of the pressure chambers are prepared for corresponding to two types of liquids which are mutually different in a volume of liquid-droplets to be jetted.

In the base plate 16 adjacent to the lower surface of the cavity plate 17, communication holes 37 each connecting to the one end 36*a* of one of the pressure chambers 36 are bored. This base plate 16 forms the surfaces, of the pressure chambers 36, on a side facing the piezoelectric actuator 2. Since the rigidity of the base plate 16 also have an effect to the transmittance of the jetting pressure, in order to efficiently transmit a jetting pressure, applied from the piezoelectric actuator 2 to the pressure chambers 36, to the ink, it is conceivable to make the thickness T2 of the base plate 16 (see FIGS. 3 and 4) as great (thick) as possible. However, this in turn increases the channel length, the channel diameter, and/or the like for the through passages 38 and the communication holes 37, thereby causing an adverse effect such as an occurrence of disturbance in the frequency of pressure wave generated in the pressure chambers. Therefore, it is desirable that the thickness T2 of the base plate 16 is 100 μm to 150 μm. Note that the thickness T2 of the base plate 16 (member which defines the surfaces of the pressure chambers 36 on the side facing the piezoelectric actuator 2) means a thickness in the stacking direction of the base plate 16. The results of an experiment conducted with respect to the thickness T2 of the base plate 16 will be described later on.

In the supply plate 15 adjacent to the lower surface of the base plate 16, there are provided connection channels 40 which supply the ink, from the common ink chambers 7, to the pressure chambers 36 respectively. As shown in FIG. 3, each of the connection channels 40 is provided with an inlet hole 40*a* to which the ink from one of the common ink chambers 7 enters, an outlet hole 40*b* which opens to face one of the communication holes 37, and a throttle (narrowed portion) 40*c* located between the inlet hole 40*a* and the outlet hole 40*b* and formed with a small cross-sectional area so as to have the largest channel resistance therein among portions in the connection channel 40. This throttle 40*c* is provided for preventing the reverse flow of the ink to the side of the common ink chamber 7 and for advancing toward the ink efficiently to the nozzle 4 when the pressure chamber 36 receives a jetting pressure for jetting the ink from the nozzle 4.

In the two manifold plates 14*a*, 14*b*, five pieces of the common ink chambers 7 are formed. Each of the common ink chambers 7 is long in a longitudinal direction (X direction) of the manifold plates, extends along one of the rows of nozzles 4 (nozzle rows) and penetrates through the plate thicknesses of the manifold plates 14*a*, 14*b*. Namely, as shown in FIGS. 2 and 3, the five common ink chambers (manifold chambers) 7 in total are formed by stacking the two manifold plates 14*a*, 14*b*, and by covering the upper surface and the lower surface thereof by the supply plate 15 and the damper plate 13, respectively. Each of the common ink chambers 7 overlaps with portions (parts) of the pressure chambers 36 in one of the pressure-chamber rows and is elongated (extended) in the stacking direction of the plates along a row direction of the pressure chambers 36 (row direction of the nozzles 4) in plan view.

As shown in FIGS. 2 and 3, at a side of the lower surface of the damper plate 13 adjacent to the lower surface of the manifold plate 14*a*, damper chambers 41 are formed as dents isolated from the common ink chambers 7. As shown in FIG. 2, the position and shape of each of the damper chambers 41 are matched with one of the common ink chambers 7. Since this damper plate 13 is made of a metal material which can elastically deform as appropriate, a ceiling portion in a thin plate shape at the upper side of each of the damper chambers 41 can freely vibrate toward both the common ink chamber 7 and the damper chamber 41. When a pressure fluctuation generated in a certain pressure chamber 36, among the pressure chambers 36, upon the ink-jetting is jetted is propagated to one of the common ink chambers 7, then the ceiling portion elastically deforms and vibrates to generate a damper effect to absorb and damp the pressure fluctuation, thereby preventing a cross-talk which is a phenomenon that the pressure fluctuation in the certain pressure chamber 36 is propagated to another pressure chamber 36.

Further, as shown in FIG. 2, four ink supply holes 42 are bored, in the cavity plate 17 at one end thereof in the short direction, as inlets for the ink to the cavity unit 1. Four connection holes 43 are bored in each of the base plate 16 and the supply plate 15, corresponding the positions, of the four connection holes 43, in the up and down direction to those of the four ink supply holes 42. The ink from an ink supply source is supplied to each of the common ink chambers 7 at one end in a longitudinal direction thereof, via one of the ink supply holes 42 and one of the connection holes 43. A filter body 20, having filtering parts 20*a* corresponding to openings of the ink supply holes respectively, is adhered to the four ink supply holes 42 with an adhesive or the like.

In this embodiment, five pieces of the common ink chambers 7 are provided while four pieces of the ink supply holes 42 and four pieces of the connection holes 43 are provided; and among the ink supply holes, only an ink supply hole 42 located on the left end in FIG. 2 is constructed to supply the ink to two pieces of the common ink chambers 7, 7. This ink supply hole 42 is arranged to be supplied with a black ink, taking into consideration that the black ink is used more frequently than other color inks. To the remaining ink supply holes 42, a yellow ink, a magenta ink and a cyan ink are independently supplied respectively.

On the other hand, similarly to a known structure, for example, one disclosed in Japanese Patent Application Laid-open No. 2002-254634 (corresponding to U.S. Pat. No. 6,595,628) or the like, the piezoelectric actuator 2 is provided with a plurality of ceramics layers which have a flat shape and a size to cover all the pressure chambers 36 and which are stacked in a direction orthogonal to a flat direction thereof, and a plurality of electrode layers arranged on a surface in the flat direction of the ceramics layers. Here, the electrode layers are formed with a conductive paste by a printing method or the like on sheet surfaces of an appropriate number of green sheets. The green sheets are obtained from a plurality of green sheets of piezoelectric ceramics materials which are formed to have a flat shape and made of a mixture of ceramics powder, binder, and solvent. Each of the green sheets is made to have a thickness of approximately 15 μm to 40 μm. The green sheets are stacked and burned to form the piezoelectric actuator 2.

As the electrode layers, there are provided layers of drive electrodes including layers each of which has individual electrodes 46 formed therein for the pressure chambers 36 respectively, and layers each of which has a common electrode 47 formed to cover the plurality of the pressure chambers 36; and a layer of surface electrodes 48. In the layers of drive electrodes, the layers of individual electrodes 46 and the layers of common electrodes 47 are arranged alternately in a direction in which the ceramics layers are stacked (stacking direction of the ceramic layers) so as to sandwich these ceramics layers therebetween. The layer of surface electrodes 48 is arranged on the uppermost surface of the piezoelectric actuator 2 (on the side opposite to the cavity unit) to thereby form the surface electrodes 48 separately connected to the individual electrodes 46 and the common electrodes 47, respectively, via electrical through holes (see FIG. 1). The surface electrodes 48 are each connected electrically to the flexible flat cable 3.

In the piezoelectric actuator 2 in which electrode layers are provided in such a manner, a high voltage is applied between the individual electrodes 46 and the common electrodes 47 in a publicly known manner, so as to polarize portions of the ceramics layer sandwiched between the individual and common electrodes, thereby forming these portions as active portions 54 having a piezoelectric characteristic. In this embodiment, since active portions 54 are formed in a plurality of ceramics layers (hereinafter referred to as base piezoelectric layers 51) as will be described later, these active portions 54 are in a state of being overlapped in a direction in which the piezoelectric layers are stacked (stacking direction of the piezoelectric layers). Then, in a plan view in the stacking direction, each of the individual electrodes 46 has an elongated shape corresponding to the shape of one of the pressure chambers 36, and each of the common electrodes 47 has a wide shape continuously covering the plurality of the pressure chambers 36. Accordingly, the shape in plan view of the active portions 54 overlapped is the shape of a portion at which the individual electrodes 46 and the common electrodes 47 are overlapped (see FIG. 5).

In the ceramics layers, there are provided the base piezoelectric layers 51, each of which is sandwiched by the individual electrodes 46 and the common electrode 47 thereabove and thereunder, and in each of which the active portions 54 are formed; a bottom layer 52 arranged between the cavity unit 1 and an lowermost base piezoelectric layer 51 among the base piezoelectric layers 51 and including no active portions 54; and a top layer 53 arranged on an uppermost base piezoelectric layer 51, among the base piezoelectric layers 51*a*, on a side thereof opposite to the cavity unit 1 and including no active portions 54.

The top layer 53 is provided for efficiently transmitting the displacement of the active portions 54 to the side of the pressure chambers 36 by preventing the displacement of the active portions 54 from escaping to the side opposite to the pressure chambers 36 (to the side of top layer 53). The bottom layer 52 is provided for preventing short-circuit between electrodes or the like which would be otherwise caused by the ink in the pressure chambers 36 permeating the piezoelectric actuator 2 covering the openings of the pressure chambers 36. In this embodiment, the plurality of base piezoelectric layers 51 and a plurality of top layers 53 are provided while one piece of the bottom layer 52 is provided. FIG. 4 illustrates an embodiment constructed of four base piezoelectric layers 51, one bottom layer 52, and two top layers 53. Note that the term "one layer" used herein means a layer formed of one piece of the green sheet, and in a case, for example, in which two pieces of the green sheet are stacked and burned without sandwiching any electrode layer, and the two green sheets appear to be integrated, it is considered in this case that there are formed two layers.

The plate-type piezoelectric actuator 2 constructed in such a manner is stacked on and adhered and fixed to the cavity unit 1 so that the stacking direction of the piezoelectric layers matches with the stacking direction of the piezoelectric actuator 2 and the cavity unit 1. The individual electrodes 46 of the piezoelectric actuator 2 are arranged so as to correspond to the pressure chambers 36, respectively. Further, the aforementioned flexible flat cable 3 (see FIG. 3) is joined to the upper surface of this piezoelectric actuator 2 so as to electrically connect various types of patterns (not shown) in this flexible flat cable 3 to the surface electrodes 48, respectively.

In the ink-jet head 100 having the above-described structure, in view of highly integrating (desifying) the pressure chambers 36 corresponding to a highly integrated nozzle arrangement, and in view of improving the image quality by micronizing the liquid-droplet volume, the length L1 in a longitudinal direction of each of the active portions 54 is set to be not more than 1.5 mm, preferably approximately 1.2 mm to 1.3 mm when the length of each of the pressure chambers 36 is 1.4 mm. When the length of each of the pressure chambers 36 is 1.1 mm, the length L1 in the longitudinal direction of each of the active portions 54 is set to approximately 0.9 mm. Then, the inventor have conducted various experiments for jetting desired minute liquid-droplets at a predetermined speed even when the active portions 54 with such a short length are used. As a result, it was found out that, with respect to the pressure chambers 36 having the aforementioned width (W1) of 240 μm to 280 μm, it is suitable to set the width W3, of the individual electrodes 46, which is parallel to the width of the pressure chambers 36, to be 140 μm to 160 μm. The shape of an area at which the individual electrode 46 and the common electrode 47 are overlapped (overlapping area) is reflected to the shape in plan view of each of the active portion 54 as it is. Therefore, the width (length in a short direction) of the shape in plan view of each of the active portions 54 becomes W3 (=140 μm to 160 μm) (see FIG. 5).

Further, as the result of the experiments, it was found out that the thickness of one piece of the layers in the piezoelectric actuator is preferably 15 μm to 40 μm. More specifically, it was found out that the thickness of each of the base piezoelectric layers 51 is preferably 15 μm to 30 μm, whereas the thickness of the top layers 53 and the thickness of the bottom layer 52 are preferably 25 μm to 40 μm, which are greater than the thickness of each of the base piezoelectric layers 51. Further, it is allowable that the thickness of a base piezoelectric layer 51 closest to the top layer among the base piezoelectric layers 51, is set to be 25 μm to 40 μm, instead of allowing the top layers 53 to have the thickness of 25 μm to 40 μm. In such a manner, by making the layers nearer to the top and bottom portions, respectively, of the piezoelectric actuators have greater thicknesses substantially in a vertically symmetrical manner, it is possible to prevent the warpage which would be otherwise caused due to the unbalance, in thickness, the layers nearer to the top and bottom portions, respectively, of the piezoelectric actuators when the piezoelectric actuator is subjected to burning during the production of the piezoelectric actuator. This makes it possible to make the active portions in the piezoelectric actuator act on the plurality of the pressure chambers in a substantially uniform manner.

Figures 6A, 6B:
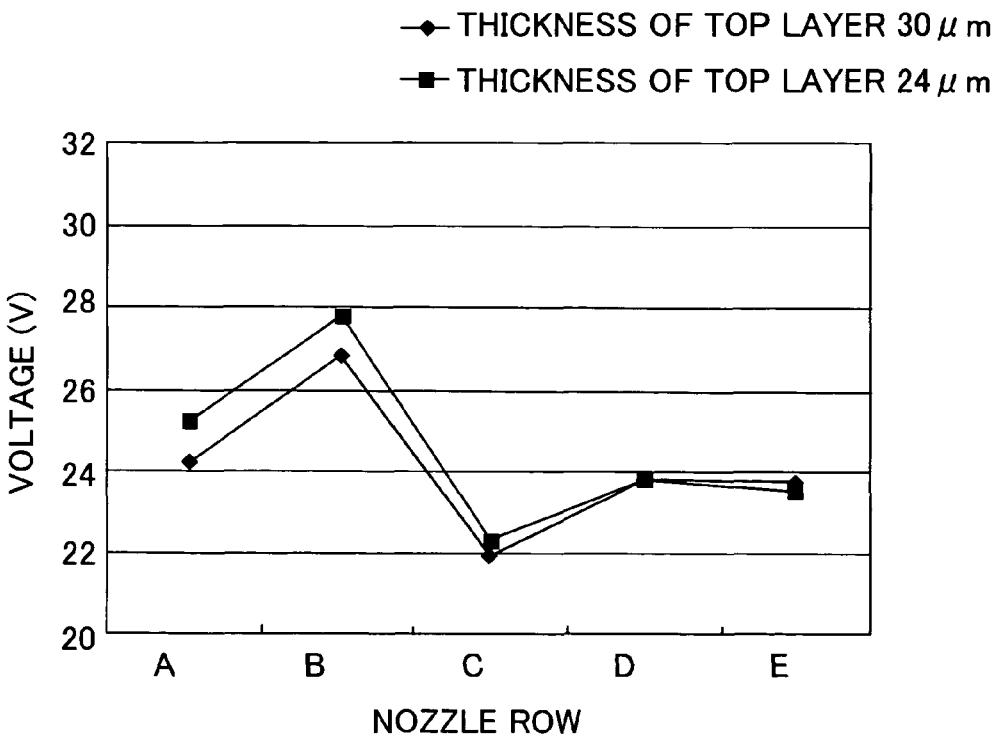
FIG. 6A is a table showing conditions of nozzle rows used in an experiment.
FIG. 6B is a graph showing a relationship between the thickness of a top piezoelectric layer and a drive voltage.

FIG. 6B shows results of the experiment to investigate as to how the drive voltage (voltage V) changes according to the thicknesses of the top layers 53. As shown in FIG. 6A, this experiment was performed for five types of nozzle rows A to E which are mutually different in PZT active-portion length (L1), pressure chamber length (L2), and nozzle diameter. In the nozzle row A, L2=1.2 mm and L1=0.9 mm; in the nozzle row B, L2=1.1 mm and L1=0.8 mm; in the nozzle row D, L2=1.5 mm and L1=1.2 mm; in the nozzle row E, L2=1.6 mm and L1=1.3 mm; and in the nozzle row C, for comparison purpose, L2=1.8 mm and L1=1.7 mm. Then, drive voltage values (described as "voltage" in the vertical axis) for obtaining a desired jetting speed of 9 m/s were compared among the nozzle rows. Note that the diameter of the nozzles 4 is set to 18.0 μm for the pressure chambers having lengths 1.2 mm and 1.1 mm; and the diameter of the nozzles 4 is set to 20.5 μm for the pressure chambers having lengths of 1.8 mm, 1.5 mm and 1.6 mm. As a result of the experiment, in the four nozzle rows A to D, other than the nozzle row E, the drive voltage are same or lower in a case in which the thicknesses of the top layers 53 are made greater (30 μm) than the thicknesses of the other layers, than the drive voltage in another case in which the thicknesses of the top layers 53 are equal (24 μm) to the thicknesses of the other layers. Therefore, it was confirmed that the drive voltage for obtaining the desired jetting speed can be lowered by making the thicknesses of the top layers 53 thicker than the thicknesses of the layers other than the top layers.

Further, it was confirmed that, when the nozzle rows A and B are compared (L2=1.1±0.1 mm), the drive voltage can be lowered in the nozzle row A (L1=0.9 mm) than the drive voltage in the nozzle row B (L1=0.8 mm). Furthermore, it was confirmed that, when the nozzle rows D and E are compared (L2=1.4±0.1 mm), the drive voltage is hardly different between the nozzle row D (L1=1.2 mm) and the nozzle row E (L1=1.3 mm). From these results, it can be appreciated that the PZT active-portion length L1 affects the drive voltage more largely in a case where the pressure chamber length L2 is 1.1±0.1 mm than in a case where the pressure chamber length L2 is 1.4±0.1 mm.

Figure 7A:
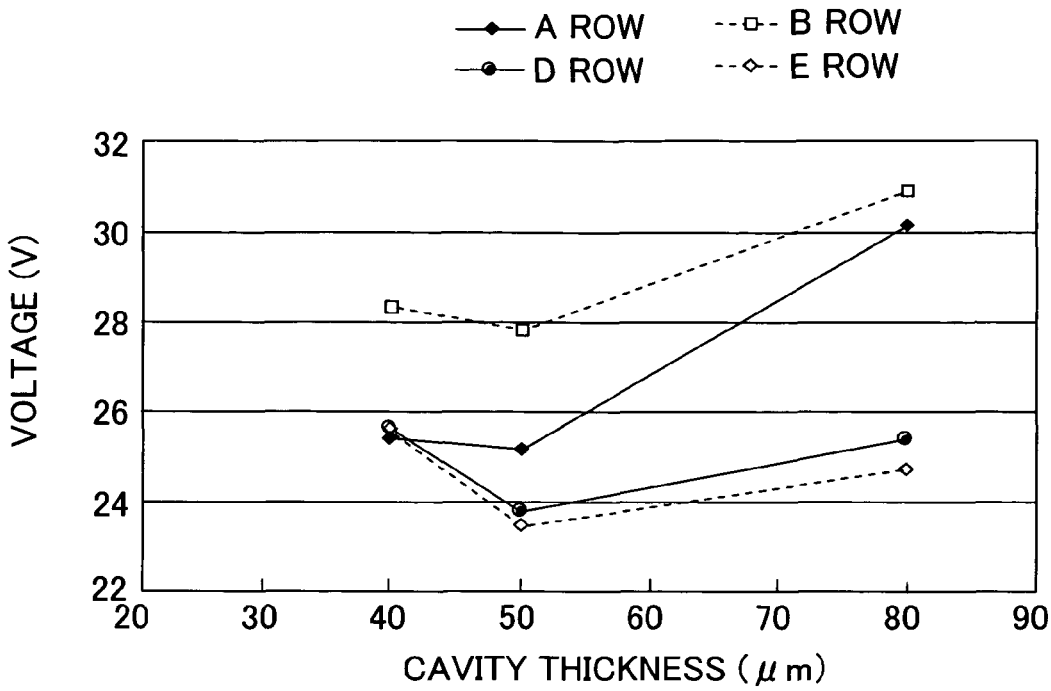
FIG. 7A is a graph showing a relationship between the thickness of the cavity plate and the drive voltage.

Next, a comparative experiment regarding the height of the pressure chambers 36 is shown in FIG. 7A. As the cavity plate 17 and as the base plate 16, which defines the surfaces of the pressure chambers 36 on the side facing the piezoelectric actuator 2, a 42% nickel alloy steel plates was used in the experiment. There were prepared three types of the cavity plate 17 with thicknesses of 40 μm, 50 μm, 80 μm, respectively (described as "cavity thickness" on the horizontal axis), and the four conditions of nozzle rows A, B, D, E shown in FIG. 6A are combined with these three types of the cavity plate so as to compare drive voltage values (described as "voltage" on the vertical axis) for obtaining a desired jetting speed of 9 m/s. As a result, as shown in FIG. 7A, it was found out that the drive voltage becomes lower in a case, in which the thickness T1 of the cavity plate 17 (height of each of the pressure chambers) is 50 μm, than in a case in which the thickness T1 is set to thicknesses other than 50 μm (namely, 40 μm, 80 μm). Further, in the nozzle rows A, D, E, the drive voltage is lower than that of the nozzle row B; and that particularly the nozzle rows D, E are hardly different in drive voltage. Furthermore, it is presumable from FIG. 7A that the thickness of not more than 60 μm makes it possible to drive not only the nozzle rows D, E but also the nozzle row A sufficiently by a low voltage. Therefore, it was found out that as the height T1, including tolerances, of each of the pressure chambers, a value of the aforementioned 40 μm to 60 μm is optimum; and that as the length L1 of each of the active portions, a length of 1.3 mm to 0.9 mm is optimum. In these cases, the drive voltage value for obtaining the desired jetting speed of 9 m/s can be made to fall in the range of 23.5 V to 27 V.

Figure 7B:
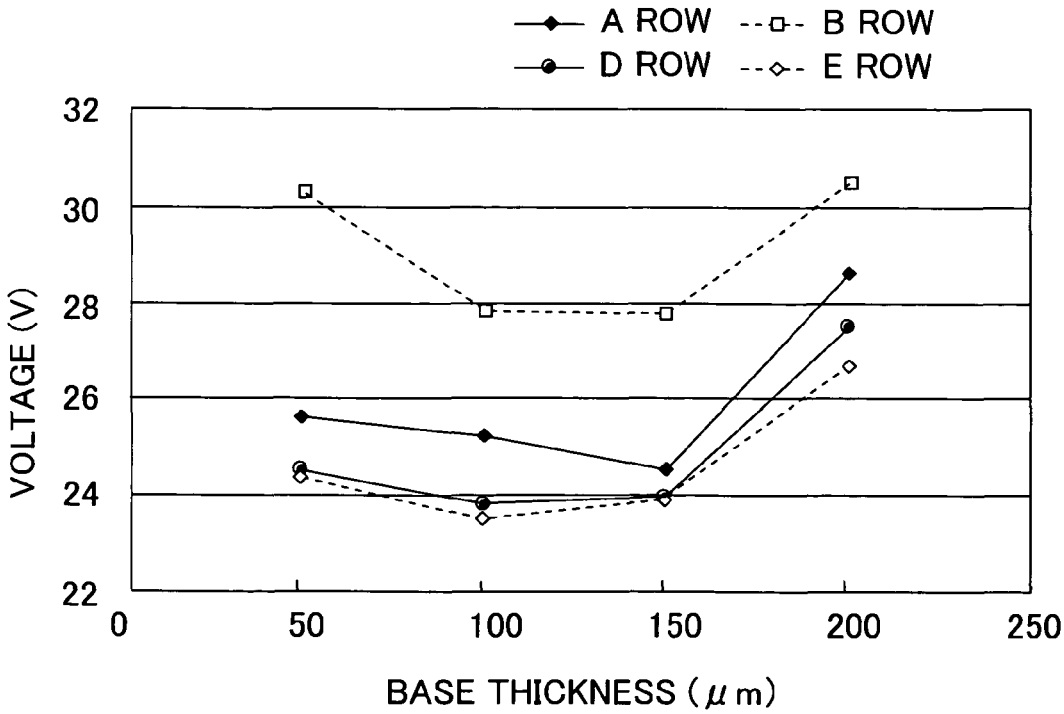
FIG. 7B is a graph showing a relationship between the thickness of a base plate and the drive voltage.

Next, a comparative experiment regarding the thickness of the base plate 16 as the member which defines the surfaces of the pressure chambers 36 on the side facing the piezoelectric actuator 2 is shown in FIG. 7B. As the cavity plate 17, and as the base plate 16 which defines the surfaces of in the pressure chambers 36 on the side opposing the piezoelectric actuator 2, a 42% nickel alloy steel plate was used in this experiment. In the above-described embodiment, there were prepared four types of the base plate 16 having thicknesses of 50 μm, 100 μm, 150 μm, 200 μm respectively; and four conditions of nozzle rows A, B, D, E shown in FIG. 6A are combined with these four types of the base plate 16 so as to compare drive voltage values (described as "voltage" on the vertical axis) for obtaining a desired jetting speed of 9 m/s. As a result, as shown in FIG. 7B, it was found out that the drive voltage becomes lower in a case, in which the thickness of the base plate 16 is 100 μm to 150 μm, than in cases other than this case. Further, in the nozzle rows A, D, E, the drive voltage was lower than that in the nozzle row B; and particularly in the nozzle rows D, E, the drive voltages are hardly different from each other. Therefore, it was found out that as the thickness T2, including tolerances, of the base plate 16, a value of the aforementioned 100 μm to 150 μm is optimum; and that as the length L1 of each of the active portions 54, a length of 1.3 mm to 0.9 mm is optimum.

It is necessary that the stiffness of the base plate 16 is high for transmitting a jetting pressure from the piezoelectric actuator 2 efficiently to the ink in the pressure chambers 36. Therefore, it is conceivable to make the thickness T2 of the base plate 16 as thick as possible, but the drive voltage is high when the thickness T2=200 μm. The cause for this can be conceived that, as the thickness of the base plate 16 is increased, the channel length, channel diameter, and the like of the through passages 38 and the communication holes 37 are also increased to cause effects such as the disturbance in the cycle (frequency) of pressure wave generated in the ink in the pressure chambers, or the like.

Figures 8A, 8B:
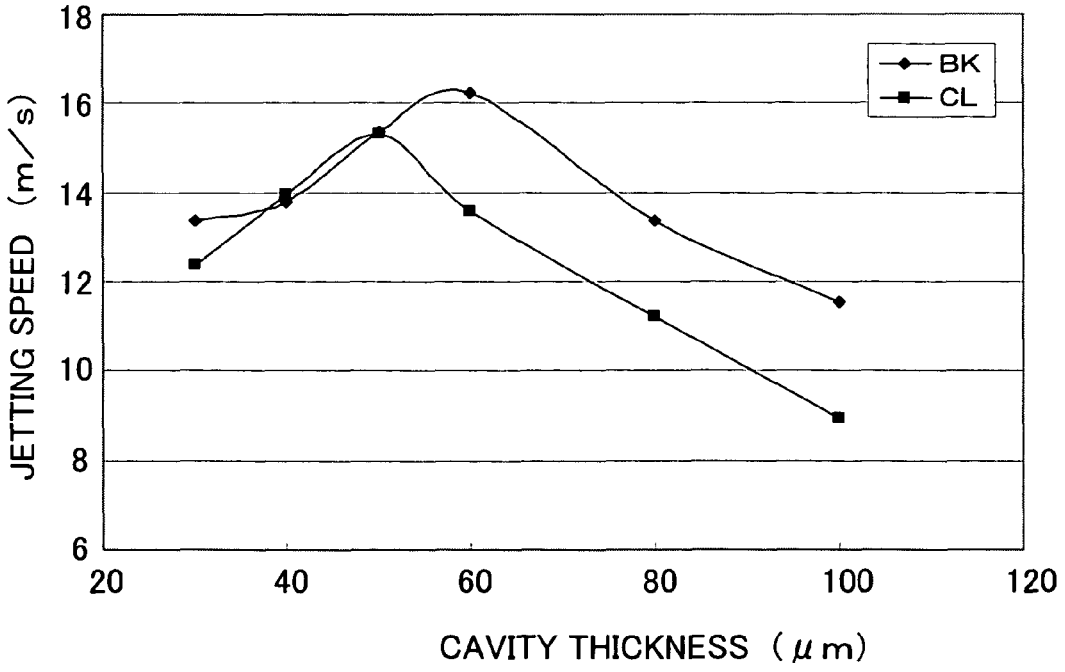
FIG. 8A is a table showing a relationship between the thickness of the cavity plate and a jetting speed of ink (ink-jetting speed)
FIG. 8B is a graphic presentation of FIG. 8A.

Next, to verify the optimum values for the cavity thickness obtained from the results shown in FIG. 7A, a simulation was performed. The simulation was conducted to see, in a case that the drive voltage of the piezoelectric actuator is constant, how the jetting speed of the ink is changed when the thickness T1 of the cavity plate 17 is changed. This simulation is based on the principle of operation of the piezoelectric actuator as follows. When a drive voltage is applied to the electrode layers in the piezoelectric actuator, active portions 54 extend in the thickness direction of the base piezoelectric layer 51, which decreases the volume of a pressure chamber 36, corresponding to the active portions 54, so as to increase the pressure of the ink inside the pressure chamber 36, thereby jetting the ink from a nozzle corresponding to the pressure chamber. Here, when the thickness T1 of the cavity plate 17 (namely, the height of the pressure chambers 36) is changed, the volume change rate of the pressure chambers 36 becomes different, so that an amount in which the volume of the pressure chamber 36 is decreased (volume decrease amount) changes even when the same drive voltage is applied. Therefore, the pressure applied to the ink inside the pressure chamber 36 is changed also, and consequently the jetting speed of ink is changed, too. The simulation was carried out that in the piezoelectric actuator used in the simulation, the width W1 of the pressure chamber 36 was 260 μm and the width W3 of the individual electrode 46 was 150 μm; the drive voltage was 20 V; and two types of nozzles for black ink (black nozzle) and for color ink (color nozzle) were used. For the black nozzle, the nozzle diameter was 20.5 μm, the PZT active-portion length L1 was 1.25 mm, and the pressure chamber length L2 was 1.35 mm. For the color nozzle, the nozzle diameter was 18 μm, the PZT active-portion length L1 was 0.85 mm, and the pressure chamber length L2 was 0.95 mm. FIG. 8A shows the results of calculation performed under these conditions for a jetting speed with the black nozzle and a jetting speed with the color nozzle respectively, in cases where the thickness T1 of the cavity plate 17 was set to 30 μm, 40 μm, 50 μm, 60 μm, 80 μm, 100 μm, respectively; and these results are graphically presented in FIG. 8B. As shown in FIG. 8B, with respect to the black nozzle (BK), the jetting speed of ink increases gradually as the cavity thickness increases from 30 μm to 60 μm, and decreases when the cavity thickness exceeds 60 μm. On the other hand, in the case of the color nozzle (Cl), the jetting speed of ink increases gradually as the cavity thickness increases from 30 μm to 50 μm, and decreases when the cavity thickness exceeds 50 μm. From these results, it can be appreciated that, with respect to both of the black nozzle and the color nozzle, a much faster jetting speed can be obtained when the thickness T1 of the cavity plate 17 is in a range of 40 μm to 60 μm. The following can be considered as a cause of the above-mentioned phenomena. That is, when the thickness T1 of the cavity plate 17 is 30 μm, the cross sectional area of the pressure chamber 36 is small, and thus the channel resistance in the pressure chamber 36 is large. Accordingly, with this large channel resistance, the speed is small at which the ink flows in the pressure chamber, thereby making the jetting speed to be low. On the other hand, when the thickness T1 of the cavity plate 17 exceeds 60 μm, then the volume of the pressure chamber 36 is large, and thus a rate is small at which the pressure chamber 36 is deformed due to the displacement of the active portion 54. Accordingly, it is not possible to obtain any sufficient jetting speed for the ink.

According to the experiments conducted by the inventor, the length L1 of the active portions 54 is set smaller than the length L2 of the pressure chambers 36, by approximately 0.1 mm to 0.3 mm. However, it is found out that a difference in this range does not greatly affect the jetting speed of ink-droplets. Therefore, the length L1 of approximately 1.5 mm can be usable for the active portions 54 with respect to the length 1.6 mm of the pressure chambers 36 in the nozzle row E.

Thus, in the present invention, even when the length L1 in the longitudinal direction of the active portion 54 is set to be a small length such as not more than 1.5 mm, it is possible to suppress the increase in drive voltage, by optimizing the structure of the pressure chambers 36 and the piezoelectric actuator 2 as described above. Therefore, it is possible to highly integrate the pressure chambers 36 and to improve image quality by jetting small ink-droplets at a predetermined speed.

In the above-described embodiment, the present invention is applied to an ink-jet head for jetting ink, but the present invention is applicable also to a device for coating coloring liquid to a medium, a device for forming a thin film on a medium, or the like.

What is claimed is:

1. A liquid-droplet jetting apparatus which jets liquid droplets of a liquid from a plurality of nozzles, the apparatus comprising:

a cavity unit which has the nozzles and a plurality of pressure chambers corresponding to the nozzles respectively and extending on a predetermined plane; and a piezoelectric actuator which has a plurality of active portions extending corresponding to the pressure chambers respectively, and which is formed on the cavity unit so as to cover the plane;

wherein a length in a longitudinal direction of each of the active portions is not more than 1.5 mm;

wherein a height of each of the pressure chambers is 40 μm to 60 μm;

wherein a thickness of a member which defines surfaces, of the pressure chambers, on a side facing the piezoelectric actuator is 100 μm to 150 μm;

wherein volume of the pressure chambers in which liquid is filled is changed by displacement of the active portions so as to jet the liquid-droplets from the nozzles; and wherein the piezoelectric actuator has a plurality of individual electrode layers in each of which a plurality of individual electrodes extending corresponding to the pressure chambers respectively are formed.

2. The liquid-droplet jetting apparatus according to claim 1;

wherein a length in a short direction of each of the pressure chambers is 240 μm to 280 μm;

wherein the piezoelectric actuator has a plurality of base piezoelectric layers which are stacked, and a plurality of electrode layers which sandwich the base piezoelectric layers respectively therebetween;

wherein the electrode layers includes the plurality of individual electrode layers in each of which the plurality of individual electrodes extending corresponding to the pressure chambers respectively are formed, and a plurality of common electrode layers in each of which a common electrode is formed to cover the pressure chambers;

wherein areas, of each of the base piezoelectric layers, between the individual electrodes and the common electrode respectively are formed as the active portions;

wherein a thickness of each of the base piezoelectric layers is 15 μm to 40 μm; and wherein a length in a short direction of each of the individual electrodes is 140 μm to 160 μm.

3. The liquid-droplet jetting apparatus according to claim 2;

Wherein the piezoelectric actuator further includes a top layer arranged on a side opposite to the cavity unit with respect to the base piezoelectric layers, and a bottom layer arranged on a side opposite to the top layer with respect to the base piezoelectric layers;

wherein the active portions are included only in each of the base piezoelectric layers; and wherein a thickness of the bottom layer and a thickness of the top layer are greater than the thickness of each of the base piezoelectric layers.

4. The liquid-droplet jetting apparatus according to claim 3;

wherein the thickness of the top layer and the thickness of the bottom layer are 25 μm to 40 μm; and wherein the thickness of each of the base piezoelectric layers is 15 μm to 30 μm.

5. The liquid-droplet jetting apparatus according to claim 2;

wherein the piezoelectric actuator further includes a top layer arranged on a side opposite to the cavity unit with respect to the base piezoelectric layers, and a bottom layer arranged on a side opposite to the top layer with respect to the base piezoelectric layers;

wherein the active portions are included only in each of the base piezoelectric layers; and wherein a thickness of a base piezoelectric layer, among the plurality of base piezoelectric layers, which is closest to the top layer and a thickness of the bottom layer are greater than thicknesses of base piezoelectric layers, among the plurality of base piezoelectric layers, which are different from the piezoelectric layer closest to the top layer.

6. The liquid-droplet jetting apparatus according to claim 5;

wherein the thickness of the base piezoelectric layer closest to the top layer and the thickness of the bottom layer are 25 μm to 40 μm; and wherein the thicknesses of the base piezoelectric layers, which are different from the base piezoelectric layer closest to the top layer, are 15 μm to 30 μm.

7. The liquid-droplet jetting apparatus according to claim 1;

wherein in the cavity unit, a member in which the plurality of pressure chambers is formed and the member which defines the surfaces, of the pressure chambers, on the side facing the piezoelectric actuator are made of a nickel alloy steel plate.

8. The liquid-droplet jetting apparatus according to claim 1;

wherein the length in the longitudinal direction of each of the active portions is not more than 1.2 mm.

9. The liquid-droplet jetting apparatus according to claim 1;

wherein when the length in the longitudinal direction of each of the active portions is 0.9 mm to 1.3 mm, a drive voltage for jetting the liquid-droplets at a jetting speed of 9 m/s is 23.5 volts to 27 volts.

10. The liquid-droplet jetting apparatus according to claim 1, which is an ink-jet head.

* * * * *